US006277271B1

(12) United States Patent
Kocal

(10) Patent No.: US 6,277,271 B1
(45) **Date of Patent: *Aug. 21, 2001**

(54) PROCESS FOR THE DESULFURIZATION OF A HYDROCARBONACEOUS OIL

(75) Inventor: Joseph A. Kocal, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/373,650

(22) Filed: Aug. 13, 1999

Related U.S. Application Data

(63) Continuation-in-part of application No. 09/115,117, filed on Jul. 15, 1998, now abandoned.

(51) Int. Cl.[7] ..... C10G 17/00; C10G 45/00; C10G 29/10; C10G 27/04; C07C 7/17

(52) U.S. Cl. ..... 208/212; 208/208 R; 208/236; 208/240; 208/242; 208/196; 585/857; 585/864

(58) Field of Search ..... 208/208 R, 212, 208/196, 240, 242, 236; 585/857, 864

(56) References Cited

U.S. PATENT DOCUMENTS 2,769,760 11/1956 Annable et al. ..... 196/28
3,551,328 12/1970 Cole et al. ..... 208/240

FOREIGN PATENT DOCUMENTS 565324 10/1993 (EP) .

*Primary Examiner*—Walter D. Griffin
*Assistant Examiner*—Tam M. Nguyen
(74) *Attorney, Agent, or Firm*—John G. Tolomei; John F. Spears, Jr.; John G. Cutts, Jr.

(57) ABSTRACT

A process for the desulfurization of hydrocarbonaceous oil wherein the hydrocarbonaceous oil and a recycle stream containing sulfur-oxidated compounds is contacted with a hydrodesulfurization catalyst in a hydrodesulfurization reaction zone to reduce the sulfur level to a relatively low level and then contacting the resulting hydrocarbonaceous stream from the hydrodesulfurization zone with an oxidizing agent to convert the residual, low level of sulfur compounds into sulfur-oxidated compounds. The residual oxidizing agent is decomposed and the resulting hydrocarbonaceous oil stream containing the sulfur-oxidated compounds is separated to produce a stream containing the sulfur-oxidated compounds and a hydrocarbonaceous oil stream having a reduced concentration of sulfur-oxidated compounds. At least a portion of the sulfur-oxidated compounds is recycled to the hydrodesulfurization reaction zone.

24 Claims, 1 Drawing Sheet

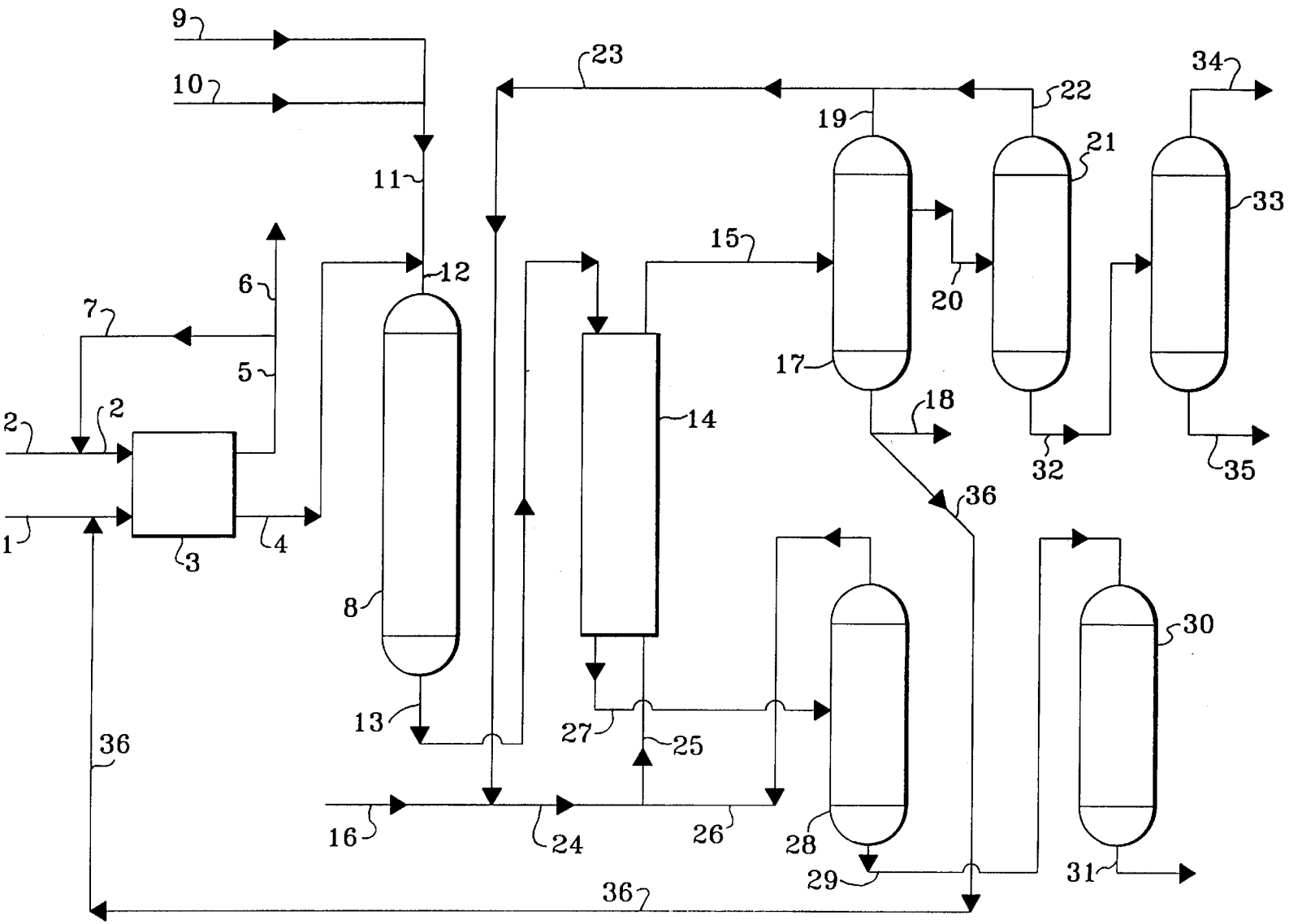
1
2
2
3
4
5
6
7
8
9
10
11
12
13
14
15
16
17
18
19
20
21
22
23
24
25
26
27
28
29
30
31
32
33
34
35
36
36

PROCESS FOR THE DESULFURIZATION OF A HYDROCARBONACEOOUS OIL

CROSS REFERENCE TO RELATED APPLICATION

This application is a continuation-in-part of U.S. application Ser. No. 09/115,117 filed Jul. 15, 1998, now abandoned, which is incorporated herein by reference.

FIELD OF THE INVENTION

The field of art to which this invention pertains is the desulfurization of hydrocarbonaceous oils to produce low concentrations of residual sulfur.

BACKGROUND OF THE INVENTION

There is an increasing demand to reduce the sulfur content of hydrocarbonaceous oil to produce products which have very low concentrations of sulfur and are thereby marketable in the ever more demanding marketplace. With the increased environmental emphasis on the requirement for more environmentally friendly transportation fuels, those skilled in the art have sought to find feasible and economical techniques to reduce the sulfur content of hydrocarbonaceous oil to low concentrations.

Traditionally, hydrocarbons containing sulfur have been subjected to a catalytic hydrogenation zone to remove sulfur and produce hydrocarbons having lower concentrations of sulfur. Hydrogenation to remove sulfur is very successful for the removal of the sulfur from hydrocarbons that have sulfur components that are easily accessible to contact with the hydrogenation catalyst. However, the removal of sulfur components which are sterically hindered becomes exceedingly difficult and therefore the removal of sulfur components to a sulfur level below about 100 ppm is very costly by known current hydrotreating techniques. It is also known that a hydrocarbonaceous oil containing sulfur may be subjected to oxygenation to convert the hydrocarbonaceous sulfur compounds to compounds containing sulfur and oxygen, such as sulfoxide or sulfone for example, which have different chemical and physical characteristics which make it possible to isolate or separate the sulfur-bearing compounds from the balance of the original hydrocarbonaceous oil. For example, see a paper presented at the 207$^{th}$ American Chemical Society Meeting in San Diego, Calif. on Mar. 13–17, 1994 entitled "Oxidative Desulfurization of Liquid Fuels" by Tetsuo Aida et al. The disadvantage to this approach is that the isolated sulfur-bearing compounds are still not useful as a sulfur-free material and therefore the yield of a sulfur-free material from the original hydrocarbonaceous oil is less than desirable and therefore uneconomic.

INFORMATION DISCLOSURE

U.S. Pat. No. 2,769,760 (Annable et al) discloses a hydrodesulfurization process which reduces the organic sulfur concentration in a hydrocarbon feedstock. The resulting hydrocarbon product from the first stage hydrodesulfurization zone contains sulfur and is subsequently introduced into a second stage partial desulfurization and/or chemical reaction wherein the second stage treatment is conducted at a temperature of approximately 450° F. and at atmospheric pressure in the absence of hydrogen. The contact material for the reaction in the second stage is of the same type as used for the hydrodesulfurization reaction. Preferred contact materials contain cobalt and molybdenum. The main thrust of the '760 patent is for the production of sweet naphthas. The exemplification of the invention in the '760 patent utilizes a hydrocarbon feedstock having an end boiling point of 425° F. The patent does not disclose the removal of sulfur compounds from a hydrocarbon by oxidation and extraction steps.

Published European Patent Application No. 565324 discloses a method of recovering an organic sulfur compound from a liquid oil wherein the method comprises treating the liquid oil containing an organic sulfur compound with an oxygen agent and separating the oxidized organic sulfur compound by separation means such as distillation, solvent extraction and/or adsorption means. A principal objective of the invention of the '324 reference is to recover organic sulfur compounds which are industrially useful in the fields of production of medicines, agricultural chemicals, and heat-resistant resins, for example. This objective contemplates the use of the organic sulfur compounds as produced. The '324 reference teaches that hydrogenation with hydrogen at high temperature and pressure cannot be employed when it is intended to isolate the organic sulfur compound from the mineral oil in such a state that the original chemical structure is maintained as much as possible to thereby utilize the organic sulfur compounds. The '324 reference teaches the undesirability of the use of hydrodesulfurization and fails to disclose that a suitable feedstock for the process of the '324 reference has been subjected to a hydrodesulfurization step.

U.S. Pat. No. 3,551,328 (Cole et al) discloses a process for reducing the sulfur content of heavy hydrocarbon petroleum fractions by oxidizing the sulfur compounds present in such heavy hydrocarbon fractions and contacting the heavy hydrocarbon fractions containing such oxidized sulfur compounds with a lower paraffinic hydrocarbon solvent in a concentration sufficient to separate the oxidized sulfur compounds from the heavy hydrocarbon fractions and recovering a heavy hydrocarbon fraction of reduced sulfur content. The '328 patent teaches that it is particularly well adaptable to the treating of crude oils and topped or reduced crude oils containing large quantities of asphaltenic material and it is especially advantageous when applied to the treating of atmospheric or vacuum tower bottoms. The patent also teaches that such feedstocks which are contaminated by the presence of excessive concentrations of various nonmetallic and metallic impurities detrimentally affect various catalytic systems employed for the conversion of such heavy hydrocarbon fractions.

SUMMARY OF THE INVENTION

The present invention provides a process for the desulfurization of hydrocarbonaceous oil wherein the hydrocarbonaceous oil is contacted with a hydrodesulfurization catalyst in a hydrodesulfurization reaction zone to reduce the sulfur level to a relatively low level and then contacting the resulting hydrocarbonaceous stream from the hydrodesulfurization zone with an oxidizing agent to convert the residual, low level of sulfur compounds into sulfur-oxidated compounds.

The remaining oxidizing agent is decomposed and the resulting hydrocarbonaceous oil stream containing the sulfur-oxidated compounds is separated to produce a stream comprising the sulfur-oxidated compounds and a hydrocarbonaceous oil stream having a reduced concentration of sulfur-oxidated compounds. At least a portion of the sulfuroxidated compounds is recycled to the hydrodesulfurization reaction zone.

In a preferred embodiment of the present invention, the hydrocarbonaceous effluent stream from the hydrodesulfurization zone is contacted with an aqueous oxidizing solution to convert the residual, low level of sulfur compounds into sulfuroxidated compounds. The resulting hydrocarbonaceous oil stream containing the sulfur-oxidated compounds is treated to decompose any residual oxidizing agent and is contacted with a selective solvent having a greater selectivity for the sulfur-oxidated compounds than for the sulfur-free hydrocarbonaceous oil to produce a solvent containing at least a portion of the sulfur-oxidated compounds and a hydrocarbonaceous oil stream having a reduced concentration of sulfur-oxidated compounds. At least a portion of the sulfur-oxidated compounds is recycled to the hydrodesulfurization reaction zone.

The present invention discloses a novel integrated process which is capable of easily and economically reducing the sulfur content of hydrocarbonaceous oil while achieving high recovery of the original feedstock. Important elements of the present invention are the minimization of the cost of hydrotreating in the integrated two-stage desulfurization process and the ability to economically desulfurize a hydrocarbonaceous oil to a very low level while maximizing the yield of the desulfurized hydrocarbonaceous oil.

One embodiment of the invention may be characterized as a process for the desulfurization of a hydrocarbonaceous oil which process comprises: (a) contacting the hydrocarbonaceous oil with a hydrodesulfurization catalyst in a hydrodesulfurization reaction zone at hydrodesulfurization conditions to produce hydrogen sulfide and a resulting first hydrocarbonaceous oil stream having a reduced concentration of sulfur; (b) contacting the first hydrocarbonaceous oil stream having a reduced concentration of sulfur with an oxidizing agent in a sulfur oxidation zone to convert sulfur-containing compounds into sulfur-oxidated compounds and to produce a sulfur oxidation zone effluent containing a residual oxidizing agent; (c) decomposing at least a portion of the residual oxidizing agent in the sulfur oxidation zone effluent; (d) separating at least a portion of the sulfur-oxidated compounds from the effluent produced in step (c) to produce a second hydrocarbonaceous oil stream having a reduced concentration of sulfur and a stream comprising sulfur-oxidated compounds; (e) recycling at least a portion of the sulfur-oxidated compounds to the hydrodesulfurization reaction zone of step (a); and (f) recovering the second hydrocarbonaceous oil stream having a reduced concentration of sulfur.

Another embodiment of the invention may be characterized as a process for the desulfurization of a hydrocarbonaceous oil which process comprises: (a) contacting the hydrocarbonaceous oil with a hydrodesulfurization catalyst in a hydrodesulfurization reaction zone at hydrodesulfurization conditions to produce hydrogen sulfide and a resulting first hydrocarbonaceous oil stream having a reduced concentration of sulfur; (b) contacting the first hydrocarbonaceous oil stream having a reduced concentration of sulfur with an aqueous oxidizing solution in a sulfur oxidation zone to produce a second hydrocarbonaceous oil stream comprising sulfur-oxidated compounds and a residual aqueous oxidizing solution; (c) decomposing at least a portion of the residual aqueous oxidizing solution in the second hydrocarbonaceous oil stream; (d) contacting the effluent stream from step (c) comprising sulfur-oxidated compounds with a selective solvent having a greater solvent selectivity for the sulfur-oxidated compounds than for sulfur-free hydrocarbonaceous oil to produce a solvent containing at least a portion of the sulfur-oxidated compounds and a third hydrocarbonaceous oil stream having a reduced concentration of sulfur-oxidated compounds; (e) recycling at least a portion of the sulfur-oxidated compounds to the hydrodesulfurization reaction zone of step (a); and (f) recovering the third hydrocarbonaceous oil stream.

Yet another embodiment of the invention may be characterized by a process for the desulfurization of a hydrocarbonaceous oil which process comprises: (a) contacting the hydrocarbonaceous oil with a hydrodesulfurization catalyst in a hydrodesulfurization reaction zone at hydrodesulfurization conditions to produce hydrogen sulfide and a resulting first hydrocarbonaceous oil stream having a reduced concentration of sulfur; (b) contacting the first hydrocarbonaceous oil stream having a reduced concentration of sulfur with an aqueous oxidizing solution in a sulfur oxidation zone to produce a second hydrocarbonaceous oil stream comprising sulfur-oxidated compounds and a residual aqueous oxidizing solution; (c) decomposing at least a portion of the residual aqueous oxidizing solution in the second hydrocarbonaceous oil stream; (d) contacting the effluent stream from step (c) comprising sulfur-oxidated compounds with a selective solvent having a greater solvent selectivity for the sulfur-oxidated compounds than for sulfur-free hydrocarbonaceous oil to produce a solvent containing at least a portion of the sulfur-oxidated compounds and a third hydrocarbonaceous oil stream having a reduced concentration of sulfur-oxidated compounds; (e) separating the solvent containing at least a portion of the sulfur-oxidated compounds produced in step (d) to produce a stream rich in sulfur-oxidated compounds and a lean selective solvent; (f) recycling at least a portion of the lean selective solvent produced in step (e) to step (d) to provide at least a portion of the selective solvent; (g) recycling at least a portion of the sulfur-oxidated compounds to the hydrodesulfurization reaction zone of step (a); and (h) recovering the third hydrocarbonaceous oil stream.

Other embodiments of the present invention encompass further details such as feedstocks, hydrogenation catalysts, oxidizing solutions, selective solvents and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

The present invention provides an improved integrated process for the deep desulfurization of hydrocarbonaceous oil in a two-stage desulfurization process. In accordance with the present invention, a preferred hydrocarbonaceous oil feedstock contains distillable hydrocarbons boiling in the range from about 200° F. (93° C.) to about 1050° F. (565° C.) and more preferably from about 300° F. (149° C.) to about 1000° F. (538° C.). The hydrocarbonaceous oil feedstock is contemplated to contain from about 0.1 to about 5 weight percent and the process is most advantageously utilized when the feedstock contains high levels of sulfur and the desired desulfurized product contains a very low concentration of sulfur. Preferred product sulfur levels are less than about 100 wppm, more preferably less than about 50 wppm, and even more preferably less than about 30 wppm.

The hydrocarbonaceous oil containing sulfur compounds is introduced into a catalytic hydrodesulfurization zone containing hydrodesulfurization catalyst and maintained at hydrodesulfurization conditions. The catalytic hydrodesulfurization zone may contain a fixed, ebullated or fluidized catalyst bed. This reaction zone is preferably maintained under an imposed pressure from about atmospheric (0 kPa gauge) to about 2000 psig (13790 kPa gauge) and more preferably under a pressure from about 100 psig (689 kPa gauge) to about 1800 psig (12411 kPa gauge). Suitably, the hydrodesulfurization reaction is conducted with a maximum catalyst bed temperature in the range from about 400 F. (204° C.) to about 750° F. (400° C.) selected to perform the desired hydrodesulfurization conversion to reduce the concentration of the sulfur compounds to the desired level. In accordance with the present invention, it is contemplated that the desired hydrodesulfurization conversion includes, for example, desulfurization, denitrification and olefin saturation. Further preferred operating conditions include liquid hourly space velocities in the range from about 0.05 $hr^{-1}$ to about 20 $hr^{-1}$ and hydrogen to feed ratios from about 200 standard cubic feet per barrel (SCFB) to about 50,000 SCFB, preferably from about 200 SCFB to about 10,000 SCFB. The hydrodesulfurization zone operating conditions are preferably selected to produce a desulfurized hydrocarbonaceous oil containing from about 100 to about 1000 wppm sulfur.

The preferred catalytic composite disposed within the hereinabove-described hydrodesulfurization zone can be characterized as containing a metallic component having hydrodesulfurization activity, which component is combined with a suitable refractory inorganic oxide carrier material of either synthetic or natural origin. The precise composition and method of manufacturing the carrier material are not considered essential to the present invention. Preferred carrier materials are alumina, silica, and mixtures thereof. Suitable metallic components having hydrodesulfurization activity are those selected from the group comprising the metals of Groups VIB and VIII of the Periodic Table, as set forth in the *Periodic Table of the Elements* E. H. Sargent and Company, 1964. Thus, the catalytic composites may comprise one or more metallic components from the group of molybdenum, tungsten, chromium, iron, cobalt, nickel, platinum, palladium, iridium, osmium, rhodium, ruthenium, and mixtures thereof. The concentration of the catalytically-active metallic component, or components, is primarily dependent upon a particular metal as well as the physical and/or chemical characteristics of the particular hydrocarbon feedstock. For example, the metallic components of Group VIB are generally present in an amount within the range of from about 1 to about 20 weight percent, the iron-group metals in an amount within the range of about 0.2 to about 10 weight percent, whereas the noble metals of Group VII are preferably present in an amount within the range of from about 0.1 to about 5 weight percent, all of which are calculated as if these components existed within the catalytic composite in the elemental state. In addition, any catalyst employed commercially for hydrodesulfurizing middle distillate hydrocarbonaceous compounds to remove nitrogen and sulfur may function effectively in the hydrodesulfurization zone of the present invention. It is further contemplated that hydrodesulfurization catalytic composites may comprise one or more of the following components: cesium, francium, lithium, potassium, rubidium, sodium, copper, gold, silver, cadmium, mercury and zinc.

The hydrocarbonaceous effluent from the hydrodesulfurization reaction zone is separated to produce a gaseous stream containing hydrogen, hydrogen sulfide and normally gaseous hydrocarbons, and a liquid hydrocarbonaceous stream having a reduced concentration of sulfur compounds. This resulting liquid hydrocarbonaceous stream in one preferred embodiment of the present invention is contacted with an aqueous oxidizing solution in an oxidation zone to convert sulfur-containing compounds into sulfur-oxidated compounds. Any suitable known aqueous oxidizing solution may be used to perform the sulfur oxidation. In a preferred embodiment, the aqueous oxidizing solution contains acetic acid and hydrogen peroxide. Preferably the molar feed ratio of hydrogen peroxide to sulfur ranges from about 1 to about 10 or more and the molar ratio of acetic acid to hydrogen peroxide ranges from about 0.1 to about 10 or more. The oxidation conditions including contact time are selected to give the desired results as described herein and the pressure is preferably great enough to maintain the aqueous solution in a liquid phase during the contacting of the hydrocarbonaceous oil. Preferred oxidation conditions include a pressure from about atmospheric to about 100 psig, and a temperature from about 100° F. (38° C.) to about 300° F. (149° C.). Since the aqueous oxidizing solution and the hydrocarbonaceous oil are immiscible, the oxidation zone must have the ability to intimately mix and contact the two phases to ensure the completion of the chemical oxidation. Any suitable means may be used for the contacting and preferred methods include the use of a packed mixing column with countercurrent flows of the two phases or in-line mixing apparatus.

In the event that there is residual hydrogen peroxide after the completion of the oxidation, it is preferred that the stream containing the residual hydrogen peroxide is contacted with a suitable catalyst to decompose the hydrogen peroxide. A preferred hydrogen peroxide decomposition catalyst is a supported transition metal, a transition metal complex or a transition metal oxide. The decomposition of the hydrogen peroxide is conducted to simplify the recovery and separation of the reaction products including sulfur-oxidated compounds recovered from the oxidation zone. Preferred decomposition operating conditions include a pressure from about atmospheric to about 100 psig (689.5 kPa) and a temperature from about 100° F. (38° C.) to about 300° F. (149° C.).

The resulting effluent from the oxidation zone after decomposition of the oxidizing agent contains desulfurized hydrocarbonaceous oil, sulfur-oxidated compounds such as sulfoxides and sulfones, for example, water and acetic acid. This resulting effluent from the oxidation zone is contacted with a selective solvent having a greater solvent selectivity for the sulfur-oxidated compounds than for the sulfur-free hydrocarbonaceous oil to produce a selective solvent containing at least a portion of the sulfur-oxidated compounds and a hydrocarbonaceous oil having a reduced concentration of sulfur. Any suitable known selective solvent may be used to selectively extract the sulfur-oxidated compounds. In a preferred embodiment of the present invention, the selective solvent is selected from the group consisting of acetonitrile, dimethyl formamide and sulfolane. The preferred selective solvents are preferably contacted with the effluent from the oxidation zone in a countercurrent extraction zone. In a preferred mode, the sulfur-oxidated compounds, water and acetic acid are extracted with acetonitrile. The raffinate containing hydrocarbonaceous oil having a reduced concentration of sulfur is introduced into a fractionation or distillation column or zone to recover dissolved trace quantities of the selective solvent. The hydrocarbonaceous oil recovered from the distillation column is preferably passed over an adsorbent such as alumina or silica, for example, in an adsorption column to produce a desulfurized hydrocarbonaceous oil preferably containing less than about 100 weight ppm, more preferably less than about 50 weight ppm and even more preferably less than about 30 wppm sulfur.

The resulting extract is introduced into a distillation zone to recover the selective solvent which is preferably recycled to the extraction zone and a stream of the sulfuroxidated compounds. In the preferred case, where the selective solvent is acetonitrile and acetic acid is used, the acetonitrile is recovered as an overhead stream from the distillation zone, the sulfur-oxidated compounds are recovered as a bottoms stream and an admixture of water and acetic acid is withdrawn as a side-cut stream and distilled to recover acetic acid, water and acetonitrile.

DETAILED DESCRIPTION OF THE DRAWING

In the drawing, the process of the present invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a hydrocarbonaceous oil containing sulfur is introduced into the process via conduit 1 and enters hydrogenation zone 3 along with a recycle stream containing sulfur-oxidated compounds transported via conduit 36. A fresh hydrogen stream is introduced via conduit 2 and is admixed with a hydrogen-rich gaseous recycle stream provided via conduit 7 and the resulting admixture is introduced into hydrogenation zone 3 via conduit 2. A gaseous stream containing hydrogen, hydrogen sulfide and normally gaseous hydrocarbons is removed from hydrogenation zone 3 via conduit 5 and at least a portion is recycled via conduit 7 as described hereinabove and at least another portion is removed from the process via conduit 6. A hydrocarbonaceous stream having a reduced concentration of sulfur is removed from hydrogenation zone 3 via conduit 4 and introduced into sulfur oxidation zone 8 via conduit 12 along with a carboxylic acid stream provided via conduits 9 and 11 and an aqueous hydrogen peroxide stream which is introduced into the process via conduits 10 and 11. The aqueous stream and the hydrocarbonaceous stream are intimately admixed in sulfur oxidation zone 8 in order to oxidize the sulfur compounds. A resulting reacted mixture is removed from sulfur oxidation zone 8 via conduit 13 and introduced into countercurrent extraction zone 14 and is extracted with a selective solvent which is introduced into the process via conduit 16 and introduced into countercurrent extraction zone 14 via conduits 24 and 25. A resulting hydrocarbonaceous stream containing a reduced concentration of sulfur is removed from countercurrent extraction zone 14 via conduit 27 and introduced into distillation zone 28. A stream rich in selective solvent is removed from distillation zone 28 via conduit 26 and is recycled to countercurrent extraction zone 14 via conduit 25. A hydrocarbonaceous stream having a reduced concentration of sulfur compounds and containing trace impurities is removed from distillation zone 28 via conduit 29 and introduced into adsorption zone 30 and a resulting purified stream of desulfurized hydrocarbonaceous compounds is removed from adsorption zone 30 via conduit 31 and recovered. A rich selective solvent containing sulfur oxides, water and carboxylic acid is removed from countercurrent extraction zone 14 via conduit 15 and is introduced into distillation zone 17. A stream rich in selective solvent is removed from distillation zone 17 via conduit 19 and is recycled to countercurrent extraction zone 14 via conduits 23, 24 and 25. A stream rich in sulfur-oxide compounds is removed from distillation zone 17 via conduit 18 and at least a portion is recycled to hydrogenation zone 3 via conduit 36 and the balance, if any, is recovered. A side-cut stream containing water and carboxylic acid is removed from distillation zone 17 via conduit 20 and introduced into distillation zone 21. A stream rich in selective solvent is removed from distillation zone 21 via conduit 22 and recycled to countercurrent extraction zone 14 via conduits 23, 24 and 25. An aqueous carboxylic acid stream is removed from distillation zone 21 via conduit 32 and introduced into distillation zone 33. A stream rich in water is removed from distillation zone 33 via conduit 34 and recovered. A stream rich in carboxylic acid is removed from distillation zone 33 via conduit 35 and recovered.

The process of the present invention is further demonstrated by the following illustrative embodiment. This illustrative embodiment is, however, not presented to unduly limit the process of this invention, but to further illustrate the advantages of the hereinabove-described embodiment. The following results were not obtained by the actual performance of the present invention but are considered prospective and reasonably illustrative of the expected performance of the invention based upon sound engineering calculations.

ILLUSTRATIVE EMBODIMENT

A stream of straight-run vacuum gas oil boiling in the range of about 600° F. to about 900° F. and containing about 2 weight percent sulfur is introduced into a hydrodesulfurization zone containing a hydrodesulfurization catalyst which contains alumina, nickel, molybdenum and phosphorus. A recycle stream containing sulfuroxidated compounds is also introduced into the hydrodesulfurization zone. The hydrodesulfurization zone is operated at a pressure of 1700 psig, a hydrogen circulation rate of 5000 SCFB and a maximum catalyst temperature of 740° F to reduce the residual sulfur in the resulting desulfurized vacuum gas oil to about 500 weight ppm (0.05 weight percent). The desulfurized vacuum gas oil along with the liquid recycle stream is then introduced into an oxidation reaction zone and contacted with acetic acid and hydrogen peroxide in water. The molar feed ratio of hydrogen peroxide to sulfur is about 5 and the molar ratio of acetic acid to hydrogen peroxide is about 5, and the contacting is conducted at a temperature of 150° F. (65° C.) and a pressure of 30 psig. The effluent from the oxidation reaction zone is passed over a catalyst containing a mixed oxide of iron and molybdenum to decompose the unreacted hydrogen peroxide and then introduced into a countercurrent extractor wherein the sulfur-oxide compounds, water and acetic acid are extracted with acetonitrile as a selective solvent. The raffinate is fed to a distillation column and trace quantities of acetonitrile are separated, recovered and recycled to the extractor. The resulting desulfurized gas oil and liquid recycle stream are then passed over an alumina adsorbent in an adsorption column to produce a finished hydrocarbonaceous oil product containing less than 50 weight ppm sulfur. The rich solvent extract is introduced into a distillation column to recover the acetonitrile solvent as an overhead stream which is recycled to the extractor. A bottoms stream containing the sulfur-oxide compounds is recovered from the distillation column and a mixture of water and acetic acid is withdrawn from the distillation column as a side-cut stream and fed to two subsequent distillation columns to recover acetic acid, water and trace quantities of acetonitrile.

The foregoing description, drawing and illustrative embodiment clearly illustrate the advantages encompassed by the process of the present invention and the benefits to be afforded with the use thereof.

What is claimed:

1. A process for the desulfurization of a hydrocarbonaceous oil which process comprises:

(a) contacting said hydrocarbonaceous oil with a hydrodesulfurization catalyst in a hydrodesulfurization reaction zone at hydrodesulfurization conditions to produce hydrogen sulfide and a resulting first hydrocarbonaceous oil stream having a reduced concentration of sulfur;

(b) contacting said first hydrocarbonaceous oil stream having a reduced concentration of sulfur with an oxidizing agent in a sulfur oxidation zone to convert sulfur-containing compounds into sulfuroxidated compounds and to produce a sulfur oxidation zone effluent containing a residual oxidizing agent;

(c) decomposing at least a portion of said residual oxidizing agent in the sulfur oxidation zone effluent;

(d) separating at least a portion of said sulfur-oxidated compounds from the effluent produced in step (c) to produce a second hydrocarbonaceous oil stream having a reduced concentration of sulfur and a stream comprising sulfur-oxidated compounds;

(e) recycling at least a portion of said sulfur-oxidated compounds to said hydrodesulfurization reaction zone of step (a); and (f) recovering said second hydrocarbonaceous oil stream having a reduced concentration of sulfur.

2. The process of claim 1 wherein said hydrocarbonaceous oil boils in the range from about 300° F. (149° C.) to about 1000° F. (538° C.).

3. The process of claim 1 wherein said hydrodesulfurization reaction zone is operated at conditions which include a pressure from about 100 psig (689 kPa gauge) to about 1800 psig (12411 kPa gauge), a maximum catalyst temperature from about 400° F. (204° C.) to about 750° F. (400° C.) and a hydrogen to feed ratio from about 200 SCFB to about 10,000 SCFB.

4. The process of claim 1 wherein said hydrodesulfurization catalyst comprises a Group VIB metal component, a Group VIII metal component and alumina.

5. The process of claim 1 wherein said hydrocarbonaceous oil stream having a reduced concentration of sulfur and produced in step (a) has a sulfur level from about 100 ppm to about 1000 ppm.

6. The process of claim 1 wherein said sulfur-oxidated compounds are selected from the group consisting of sulfoxide and sulfones.

7. The process of claim 6 wherein said oxidizing agent is selected from the group consisting of a gas, a liquid and a solid.

8. The process of claim 1 wherein said oxidizing agent is selected from the group consisting of oxygen, ozone, nitrogen oxide, hydrogen peroxide, organic hydroperoxide, carboxylic peracids and metal superoxides.

9. The process of claim 1 wherein said oxidation zone contains an oxidation catalyst.

10. The process of claim 1 wherein said separation of step (d) is selected from the group consisting of extraction, distillation and adsorption.

11. The process of claim 1 wherein said decomposition of step (c) is conducted in the presence of a catalyst.

12. A process for the desulfurization of a hydrocarbonaceous oil which process comprises:

(a) contacting said hydrocarbonaceous oil with a hydrodesulfurization catalyst in a hydrodesulfurization reaction zone at hydrodesulfurization conditions to produce hydrogen sulfide and a resulting first hydrocarbonaceous oil stream having a reduced concentration of sulfur;

(b) contacting said first hydrocarbonaceous oil stream having a reduced concentration of sulfur with an aqueous oxidizing solution in a sulfur oxidation zone to produce a second hydrocarbonaceous oil stream comprising sulfur-oxidated compounds and a residual aqueous oxidizing solution;

(c) decomposing at least a portion of said residual aqueous oxidizing solution in said second hydrocarbonaceous oil stream;

(d) contacting the effluent stream from step (c) comprising sulfuroxidated compounds with a selective solvent having a greater solvent selectivity for said sulfur-oxidated compounds than for sulfur-free hydrocarbonaceous oil to produce a solvent containing at least a portion of said sulfur-oxidated compounds and a third hydrocarbonaceous oil stream having a reduced concentration of sulfur-oxidated compounds;

(e) recycling at least a portion of said sulfur-oxidated compounds to said hydrodesulfurization reaction zone of step (a); and (f) recovering said third hydrocarbonaceous oil stream.

13. The process of claim 12 wherein said hydrocarbonaceous oil boils in the range from about 300° F. (149° C.) to about 1000° F. (538° C.).

14. The process of claim 12 wherein said hydrodesulfurization reaction zone is operated at conditions which include a pressure from about 100 psig (689 kPa gauge) to about 1800 psig (12411 kPa gauge), a maximum catalyst temperature from about 400° F. (204° C.) to about 750° F. (400° C.) and a hydrogen to feed ratio from about 200 SCFB to about 10,000 SCFB.

15. The process of claim 12 wherein said hydrodesulfurization catalyst comprises a Group VIB metal component, a Group VIII metal component and alumina.

16. The process of claim 12 wherein said first hydrocarbonaceous oil stream has a sulfur level from about 100 ppm to about 1000 ppm.

17. The process of claim 12 wherein said aqueous oxidizing solution comprises hydrogen peroxide and a carboxylic acid.

18. The process of claim 12 wherein said oxidation zone is operated at conditions including a molar feed ratio of hydrogen peroxide to sulfur ranging from about 1 to about 10 and a molar ratio of carboxylic acid to hydrogen peroxide from about 0.1 to about 10.

19. The process of claim 12 wherein said oxidation zone is operated at conditions including a pressure from about atmospheric to about 100 psig and a temperature from about 100° F. (38° C.) to about 300° F. (149° C.).

20. The process of claim 12 wherein said sulfur-oxidated compounds are selected from the group consisting of sulfoxide and sulfones.

21. The process of claim 12 wherein said selective solvent is selected from the group consisting of acetonitrile, dimethyl formamide and sulfolane.

22. The process of claim 12 wherein said contacting of step (d) is conducted in a countercurrent extraction zone.

23. The process of claim 12 wherein said decomposition of step (c) is conducted in the presence of a catalyst.

24. A process for the desulfurization of a hydrocarbonaceous oil which process comprises:

(a) contacting said hydrocarbonaceous oil with a hydrodesulfurization catalyst in a hydrodesulfurization reaction zone at hydrodesulfurization conditions to produce hydrogen sulfide and a resulting first hydrocarbonaceous oil stream having a reduced concentration of sulfur;

(b) contacting said first hydrocarbonaceous oil stream having a reduced concentration of sulfur with an aqueous oxidizing solution in a sulfur oxidation zone to produce a second hydrocarbonaceous oil stream comprising sulfur-oxidated compounds and a residual aqueous oxidizing solution;

(c) decomposing at least a portion of said residual aqueous oxidizing solution in said second hydrocarbonaceous oil stream;

(d) contacting the effluent stream from step (c) comprising sulfuroxidated compounds with a selective solvent having a greater solvent selectivity for said sulfur-oxidated compounds than for sulfur-free hydrocarbonaceous oil to produce a solvent containing at least a portion of said sulfur-oxidated compounds and a third hydrocarbonaceous oil stream having a reduced concentration of sulfur-oxidated compounds;

(e) separating said solvent containing at least a portion of said sulfuroxidated compounds produced in step (d) to produce a stream rich in sulfur-oxidated compounds and a lean selective solvent;

(f) recycling at least a portion of said lean selective solvent produced in step (e) to step (d) to provide at least a portion of said selective solvent;

(g) recycling at least a portion of said sulfur-oxidated compounds to said hydrodesulfurization reaction zone of step (a); and (h) recovering said third hydrocarbonaceous oil stream.

* * * * *